US007267250B2

(12) United States Patent
Rudduck et al.

(10) Patent No.: US 7,267,250 B2
(45) Date of Patent: Sep. 11, 2007

(54) CLOSURE WITH CONCERTINA ELEMENT AND PROCESSING MEANS

(75) Inventors: Dickory Rudduck, Seaforth (AU); Michael John Laybourne Hort, Chatswood (AU)

(73) Assignee: Telezygology Inc., New South Wales (AU)

( * ) Notice: Subject to any disclaimer, the term of this patent is extended or adjusted under 35 U.S.C. 154(b) by 167 days.

(21) Appl. No.: 10/655,586

(22) Filed: Sep. 5, 2003

(65) Prior Publication Data

US 2005/0190070 A1 Sep. 1, 2005

Related U.S. Application Data

(63) Continuation of application No. PCT/AU02/00262, filed on Mar. 7, 2002.

(30) Foreign Application Priority Data

Mar. 7, 2001 (AU) ..... PR 3565
Apr. 11, 2001 (AU) ..... PR 4364

(51) Int. Cl.
*G01F 11/00* (2006.01)

(52) U.S. Cl. ..... 222/270; 222/1; 222/296; 340/309.15; 340/384.7

(58) Field of Classification Search ..... 340/309.14, 340/309.15, 309.16, 309.7, 384.7, 539.1, 340/539.22, 572.1, 572.4; 215/262, 270, 215/296; 222/1, 30, 270, 296; 141/9, 98, 141/100, 112
See application file for complete search history.

(56) References Cited

U.S. PATENT DOCUMENTS

| | | | | |
|---|---|---|---|---|
| 2,954,890 | A | 10/1960 | Del Valle | |
| 3,051,343 | A | 8/1962 | Pappas | |
| 3,098,575 | A | 7/1963 | Siebelt | |
| 3,170,597 | A | 2/1965 | Reichenberger | 222/36 |
| 3,289,875 | A | 12/1966 | Delamater | |

(Continued)

FOREIGN PATENT DOCUMENTS

| | | |
|---|---|---|
| DE | 14 82 590 | 1/1969 |

(Continued)

OTHER PUBLICATIONS

Baird, Betsy. Aug. 1999. "American DNA Testing Firm Chosen to Certify Foods in Great Britain as Not Genetically Modified." *Food Technology*. vol. 53, No. 8, p. 13.

(Continued)

*Primary Examiner*—Van T. Trieu
(74) *Attorney, Agent, or Firm*—Wilmer Cutler Pickering Hale and Dorr LLP

(57) ABSTRACT

The invention provides in a first aspect a closure (10) for a passageway such as a bottleneck. The closure (10) has a concertina element (16). When the concertina element (16) is released, the closure (10) can be removed from the passageway. The concertina element (16) may have folds (18), including compressible folds, may be in the form of a spiral. In a further aspect, the invention provides a second aspect a closure (110), which has a processing (132). The processing (132) may include a computer chip (134), is adapted to receive or convey various types of data, such as characteristics of the contents of the container closed by the closure (10). The first and second aspects may be combined.

27 Claims, 19 Drawing Sheets

U.S. PATENT DOCUMENTS

| | | | | | |
|---|---|---|---|---|---|
| 4,278,186 | A | | 7/1981 | Williamson | 222/36 |
| 4,322,022 | A | | 3/1982 | Bergman | 222/327 |
| 4,620,638 | A | * | 11/1986 | Schmidt | 215/11.1 |
| 5,014,798 | A | | 5/1991 | Glynn | |
| 5,083,454 | A | * | 1/1992 | Yopp | 73/118.1 |
| 5,318,197 | A | * | 6/1994 | Martindale et al. | 222/1 |
| 5,379,916 | A | | 1/1995 | Martindale et al. | 222/1 |
| 5,551,583 | A | * | 9/1996 | Sachathamakul et al. | 215/386 |
| 5,622,163 | A | | 4/1997 | Jewett et al. | 128/200.2 |
| 6,022,816 | A | | 2/2000 | Dewar | 442/104 |
| 6,154,686 | A | | 11/2000 | Hefferen et al. | 700/276 |
| 6,209,592 | B1 | | 4/2001 | Gilboa et al. | 141/94 |
| 6,545,594 | B1 | | 4/2003 | Knight et al. | 439/467 |
| 6,561,232 | B1 | * | 5/2003 | Frutin | 141/9 |
| 6,831,552 | B2 | * | 12/2004 | Lin | 340/384.7 |

FOREIGN PATENT DOCUMENTS

| | | | |
|---|---|---|---|
| DE | 19714735 | A1 | 10/1998 |
| DE | 299 19 460 | U1 | 2/2000 |
| DE | 19854664 | A1 | 6/2000 |
| EP | 0 757 012 | A1 | 2/1997 |
| FR | 617 727 | | 2/1927 |
| FR | 2641522 | | 7/1990 |
| GB | 1533528 | | 11/1978 |
| GB | 2 288 103 | A | 10/1995 |
| WO | WO96/03172 | | 2/1996 |
| WO | WO99/47819 | | 9/1999 |
| WO | WO99/58356 | | 11/1999 |

OTHER PUBLICATIONS

May 2000. "Packaging Gets "Smart"; IP/Motorola Move Computer Chip Move into the Package." *News Perspective*. www.packagingdigest.com/News/0500news.html. Printed Jun. 30, 2003.

Brody, Aaron L. Jun. 2000. "Smart Packaging Becomes Intellipac™." *Food Technology*. vol. 54, No. 6, pp. 104-107.

Feb. 28, 2001. "Russian Invents Talking Vodka Bottle." *Ananova*. www.ananova.com/news/story/sm_222673.html. Printed Jun. 4, 2001.

2001. "How it Works." *Bluetooth: The Official Bluetooth Website*. www.bluetooth.com/tech/works.asp. Printed Mar. 3, 2002.

Jun. 12, 2002. International Search Report from PCT/AU02/00262.

Lewis, Carol. Sep.-Oct. 2002. "Food Freshness and 'Smart' Packaging." *FDA Consumer Magazine*.

May 8, 2003. International Preliminary Examination Report from PCT/AU02/00262.

* cited by examiner

FIGURE 1
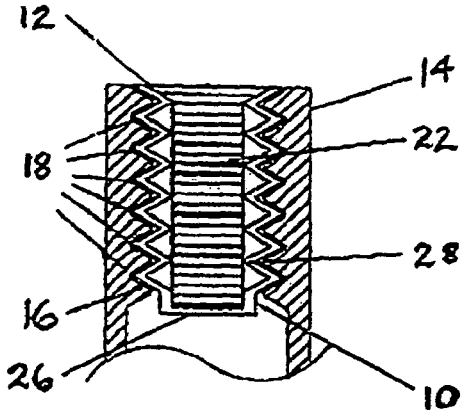
FIGURE 2
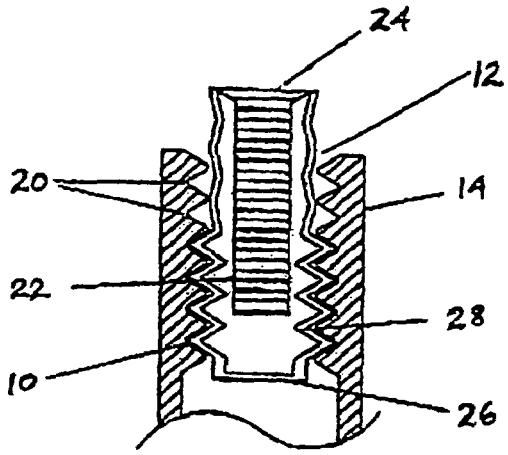
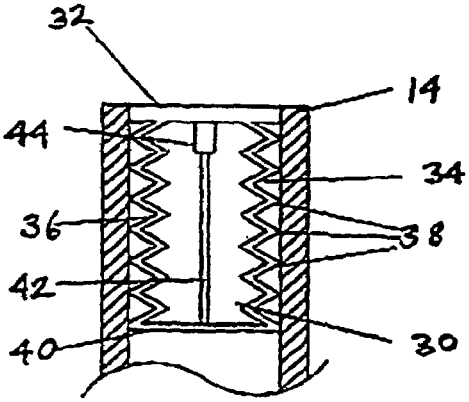
FIGURE 3
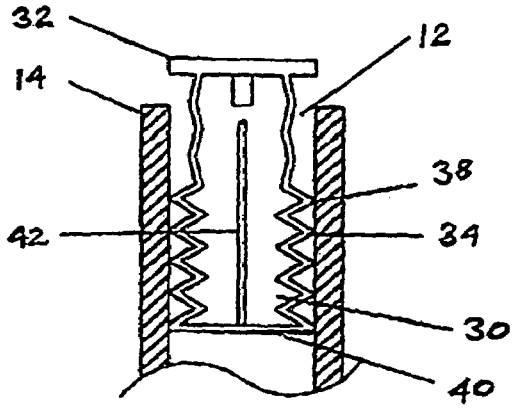
FIGURE 4

FIGURE 5
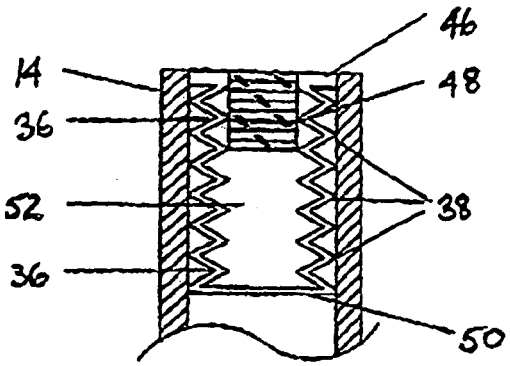
FIGURE 6
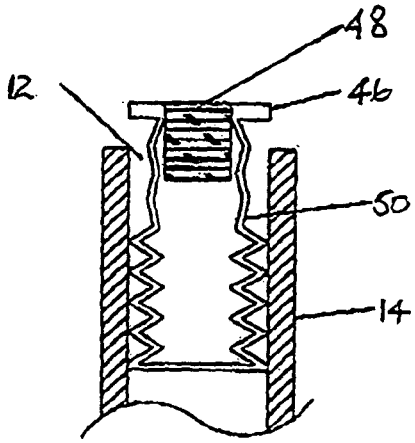
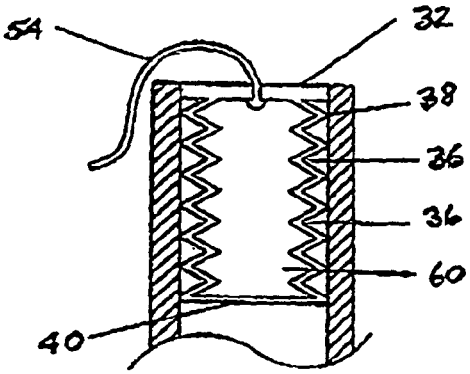
FIGURE 7
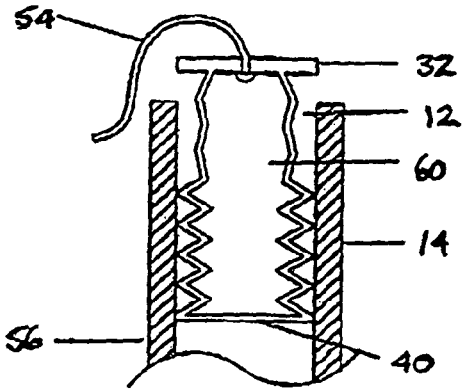
FIGURE 8

FIGURE 23
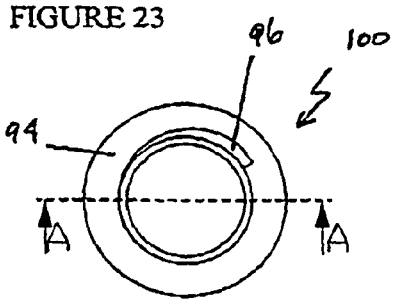
FIGURE 26
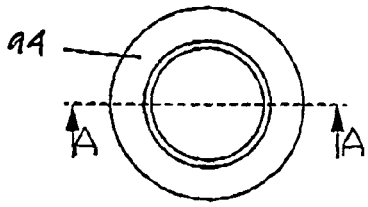
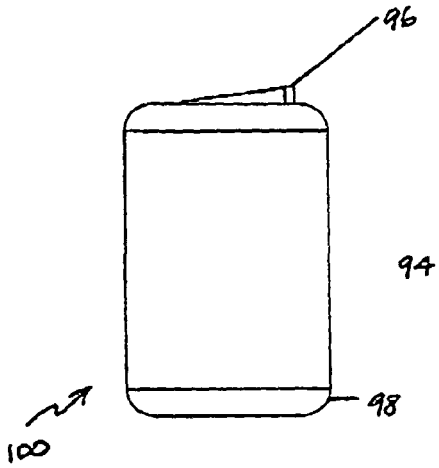
FIGURE 22
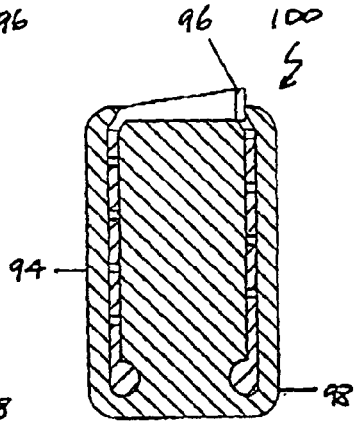
FIGURE 24
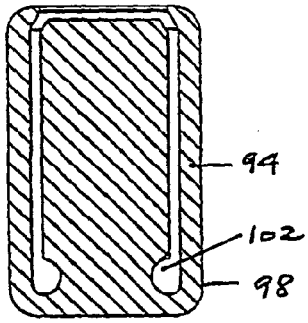
FIGURE 27
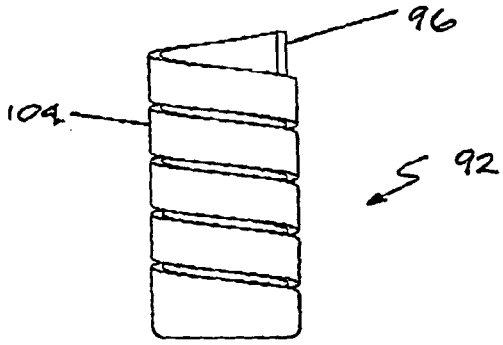
FIGURE 25

CLOSURE WITH CONCERTINA ELEMENT AND PROCESSING MEANS

RELATED APPLICATIONS

This application is a continuation of International Application No. PCT/AU02/00262, filed Mar. 7, 2002, which was published under PCT Article 21(2) in English and is incorporated herein by reference. International Application No. PCT/AU02/00262 claims priority from Australian Patent Application Nos. PR 3565 filed Mar. 7, 2001 and PR 4364 filed Apr. 11, 2001, both of which are incorporated herein by reference.

TECHNICAL FIELD

This invention relates to closures for containers having ports or openings through which the contents thereof may be dispensed. However, as persons skilled in the art will appreciate, the invention may equally apply to any arrangement in which a closure is required to seal off an aperture or port. Although in the most part the invention will be described with reference to bottle closures, it will be understood that the invention has far wider ranging applications.

BACKGROUND ART

For centuries, wine has been sealed into bottles using natural cork. It is well known that natural cork can sometimes cause tainting of the wine. It is believed that the problem arises from production of 2,4,6-trichloranisole, caused when microorganisms in natural cork combined with chemical contaminants use in production processors to kill bacteria. The tainting can be severe, in that the wine is "corked" and is undrinkable. A less severe result is that the wine, while still drinkable, has been spoiled to a sufficient degree to change the wine and to leave an undesirable impression on the consumer, who may not be aware that the wine may have been subject to tainting.

It is estimated that approximately 10% of wine sealed with natural cork is adversely affected by cork taint. This represents a significant proportion of wine production and is most undesirable, both in terms of financial loss and also damage to the substantial investment made in promotion of wine brands.

At least one attempt has been made to overcome the problem, by substituting for cork a solid or foam polymeric material which is not vulnerable to drawbacks of natural cork. The drawback with these prior art "synthetic cork" stoppers arises from the difficulty of extraction. The "synthetic cork" stoppers are designed to be removed by a corkscrew. Once a corkscrew is inserted in the stopper, the circumference of the stopper may expand slightly to wedge it even more firmly in the bottle neck. As a result, much more force is require to remove such a "synthetic cork" stopper compared with a traditional cork stopper. Use of an auger-type corkscrew can cause some "synthetic cork" stoppers to crack. In most cases, it is necessary to use a particular type of lever corkscrew to remove a synthetic cork. It can be difficult to remove a "synthetic cork" stopper using auger-type corkscrews.

BRIEF SUMMARY OF THE INVENTION

It is an aim of the present invention, for at least some embodiments, to provide a closure which does not require the use of a corkscrew or similar extraction tool. The invention in these embodiments can have enormous advantages over traditional cork stoppers and "synthetic cork" stoppers. No longer will it be necessary to provide a corkscrew in order to gain access to bottled wine.

Further, the closures of the present invention, at least in some embodiments, can be made in forms which require far less effort, compared to prior art stoppers, to remove them from bottles.

In other embodiments, the closure of the present invention can be removed with the assistance of a special tool, as will be discussed below.

It is also an aim of the present invention, for at least some embodiments, to provide a closure which is capable of reporting data relating to the contents of the container and/or to conditions to which the contents have been exposed, such as temperature or quantity of light, for example.

Accordingly, in a first aspect, this invention provides a closure for a passageway having one or more walls and a mouth defined by the wall or walls, the closure including:

An upper end adapted in use to be located at the mouth;

A base adapted in use to be located within the wall or walls remote from the mouth; and A concertina element having internal folds and external folds, the concertina element being adapted to retain the closure in use in place between the wall or walls and being capable of being unfolded to allow the closure to be removed from the wall or walls, characterized in that the base is closed.

Typically, the passageway which the closure is to seal will be a bottle neck, having a single wall forming a passageway which is circular in cross-section. However, passageways of other configuration may also be sealed by the closure of the invention; such other passageways may have cross-sections which are oval, square, rectangular, triangular or other shapes.

Similarly, the passageway is preferably of regular cross-section but this need not necessarily be the case. The closure of the invention may be adaptable to passageways which are not of regular cross section, such as passageways of funnel shape, for example. In addition, the passageway may have walls which are ribbed or threaded, instead of smooth.

The closure has an upper end adapted, in use, to be located at the mouth of the container and a base adapted in use to be located within the wall or walls of the passageway. Preferably, the closure seals the opening completely. In such case, the seal may extend only between the internal dimension of the wall or walls of the passageway, so that the seal does not cover the walls themselves. Alternately, the seal may extend to the external dimension of the walls. Embodiments of both versions are shown in the drawings, discussed below.

The length for which the closure of the invention extends from the opening at least part way along the wall or walls is preferably similar to that of a traditional cork, but may be more or less extensive if desired.

The concertina element is adapted, when folded, to retain the closure in place between the wall or walls of the passageway. The concertina element may have external folds which bear against the wall or walls of the passageway when the closure is in place. In another embodiment, the concertina element has folds which do not contact the walls of the passageway but which may bear against intermediate wall or walls of the closure. Such intermediate wall or walls, in turn, may bear against the wall or walls of the passageway. Other configurations may also be possible.

The term "concertina element" includes within its scope not only elements with traditional folds but also those with compressible folds and those with a spiral form which can be unfolded.

The concertina element is capable of unfolding (or being unfolded) or of being released from compression to allow the closure to be released from the wall or walls of the passageway. In the case where the concertina element has external folds contacting the passageway wall/s, there are various ways in which the concertina element can be caused or permitted to unfold. For example, there may be a collapsible core within the concertina element, holding the folds of the concertina element in contact with the passageway wall/s. When the core is collapsed, the tension between the concertina folds and the wall/s is reduced and the closure can be progressively withdrawn from the passageway by pulling on the closure, so as to progressively unfold the folds of the concertina element. Depending on the precise structure of the closure in this embodiment, the collapsible core may be caused to collapse by insertion of a tool, such as a corkscrew, for example and the corkscrew can be used to withdraw the collapsible core, at the same time causing the folds of the concertina element to unfold and resulting in removal of the closure. It may also be possible to remove the closure in this embodiment by manual means, without the need to utilised a tool.

In a second embodiment, the concertina folds may be held against the walls of the passageway by tension which can be broken to permit or cause removal of the closure. An example of this embodiment is illustrated in the drawings, discussed below. The tension may be maintained by a flexible or rigid element connecting one end of the element with the other, for example.

In a third embodiment, the closure may include a pellet of suitable material which, when the closure is in position, helps to maintain contact between the folds of the concertina element and the passageway. Insertion of a corkscrew into the pellet permits the pellet to be withdrawn from the passageway, at the same time unfolding the folds of the concertina element and permitting the closure to be removed.

In yet a further embodiment, the concertina element may be unfolded by manipulation of a cord or ribbon attached to the closure, so that exertion of sufficient force will unfold the folds of the concertina element.

In further embodiments, the closure may be locked into place by a locking element which can be unlocked by remote activation means. Reference is made to international patent application No. PCT/AU99/00185, the contents of which are imported herein by reference. The closure of the present invention, in these embodiments, can contain any suitable remotely activatable locking element which can be unlocked by remote means. For example, the locking element may respond to application of a magnetic field to the closure, to move the locking element to an unlocked position and thus enable the closure to be removed. Illustrations are contained in the drawings, below.

In another embodiment, the concertina element may be compressed to bear against the passageway wall.

While the above embodiments are concerned with the version of the invention where the concertina element has external folds which contact the inner wall/s of the passageway, the concertina element may be designed differently, as mentioned above. For example, the concertina element may be contained within intermediate wall/s, so that it bears against those intermediate wall/s which in turn bear against wall/s of the passageway, to form the closure. To release the closure, the concertina element is caused to unfold from between the intermediate wall/s. In doing so, the force retaining the intermediate wall/s against the passageway wall/s is removed and the closure can be withdrawn from the passageway. Embodiments of this are illustrated in the drawings.

Also illustrated in the drawings is a similar embodiment where, however, the concertina element is spiral and does not bear against the intermediate wall/s in such a way as to retain the closure in place. However, the concertina element can be used to extract the closure.

In another aspect of the invention there is provided a closure including processing means capable of interacting with external processing means.

In a further aspect of the invention there is provided a closure including processing means adapted to receive, store and communicate data and/or information.

In still another aspect of the invention there is provided a closure including a processing means adapted to receive and/or send data and/or information from or to one or more sources internal and/or external to the closure.

In yet another aspect of the invention there is provided a closure including a processing means capable of storing information wherein not all of the information is pre-programed.

In another aspect, there is provided a closure for a container adapted to store contents, the closure being removable to permit dispensing of the contents, the closure including:

seal means adapted to prevent the dispensing of the contents from the container when in the sealed position; and processing means capable of interacting with external processing means and being adapted to receive, store and communicate data and/or information concerning the contents whilst the sealed means is in the sealed position, the processing means being physically housed in or on the closure and being adapted to receive and/or send data and/or information from or to one or more sources internal and/or external to the container.

The container may include a large number of shapes, sizes, internal pressure and load capacities. The wide ranging applicability of the invention may exemplified by indicating that the container may be a concrete construction such as a dam wall or may be a small glass vial for medical purposes. The container may be adapted to store foodstuff or beverages such as milk, orange juice or wine. The container may be adapted to store pharmaceutical products in bulk for warehouse storage or for retail use. The container may be adapted to store powdered, liquid and/or gaseous chemicals.

The closure may be in the form of a plug, cap or membrane seal. For example, the closure may be in the form of a plug made of plastics or cork material adapted to seal the contents of a wine bottle. The closure may be in the form of a threaded cap adapted to seal the contents of a fuel or chemical storage container. The closure may be in the form of a snap-on cap for use on a container holding vitamins or other consumable tablets. The closure may include tamper-evident or securing is means. Advantageously, the closure may include security or locking means to resist unauthorised access. The closure may permit unlocking whereby to enable opening of the containers upon receipt of an encrypted signal.

The seal means may include any suitable means adapted to seal the contents of the container against inadvertent escape. The seal means may be static whereby to seal the container by, for example, friction fit, such as in the case of a cork, or positive engagement means, such as in the case of a threaded or snap-on cap. The seal means may include the closure described in the first aspect of this invention, above, or it may be different.

The processing means may include computer processing means. The processing means may include state of the art miniaturised computer chips. The processing means may include an integrated circuit which is "hard-wired" to carry out processes in a predetermined manner. The processing means may be able to communicate remotely with an external processing means. Alternatively, the processing means may be programmable upon input from an external source and have read/write capabilities.

The processing means is preferably located in, rather than on, the closure. The processing means may have communication ports externally accessible to a user for interaction therewith. The processing means may facilitate commercial transactions or enable the provision of promotional material to potential customers. The processing means may be linked to sensing means capable of determining the real time status or characteristics of the contents. For example, the closure may include temperature, movement, pressure, chemical and/or gaseous sensors.

As described in International application No. PCT/AU99/00185, the entire contents of which are incorporated herein by reference, the seal means may be activated by remote activation means. The activation means may; include any one of a number of devices or mechanisms via which engagement to the container may be released For example, the activation means may include one or more magnetic elements adapted to shift from a position corresponding to the closed position to a position enabling the release of the closure from the container. The activation means may include magnetic inductance means whereby to shift a magnetisable element. The activation means may include shape-memory material adapted to change dimension upon the application of heat, electrical current, electromagnetic radiation (such as radiowaves (RF)), and the like.

The activation means may be activatable on the physical docking of a control member adapted to dock into a corresponding port in or on the closure. Alternatively, the activation means may be activatable by remote means whereby the processing means is capable of receiving remote signals, such as infra red (IR) or radio frequency (RF) signals.

BRIEF DESCRIPTION OF THE DRAWINGS

Reference is now made to the drawings, which, it is to be understood, are intended to be illustrative of various embodiments of the invention but not limiting on the scope of the invention.

In the drawings, the first aspect of the invention is illustrated in FIGS. 1 to 30, while subsequent aspects of the invention are illustrated in FIGS. 31 to 50. In the drawings:

FIGS. 1 and 2 show in cross-sectional view a first embodiment of the closure of the invention;

FIGS. 3 and 4 show in cross-sectional view a second embodiment of the closure of the invention;

FIGS. 5 and 6 show in cross-sectional view a third embodiment of the closure of the invention;

FIGS. 7 and 8 show in cross-sectional view a fourth embodiment of the closure of the invention;

FIGS. 22 to 27 illustrate another embodiment having a spiral form of concertina element and an mediate wall. FIG. 22 is a side elevation, FIG. 23 is a plan view, FIG. 24 is a cross section taken along the line A-A in FIG. 23, FIG. 25 is a side elevation of the spiral form of concertina element, FIG. 26 is a plan view of the closure with the concertina element removed and FIG. 27 is a cross section taken along the line A-A of FIG. 26;

DETAILED DESCRIPTION OF THE INVENTION

Figure 9:
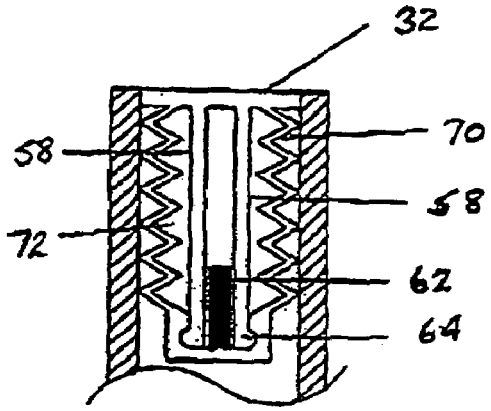
FIGS. 9 and 10 show in cross-sectional view a fifth embodiment of the closure of the invention.

Referring first to FIGS. 1 and 2, closure 10 is shown located in a opening 12 is defined by wall 14, being the neck of a bottle, the remainder of which is not shown. Closure 10 extends from opening 12 part way along wall 14, in an adequate manner so that closure 10 seals opening 12 and prevents contents of the bottle (not shown) from being removed from or leaking from the bottle while closure 10 is in place.

Closure 10 has a concertina element 16 with a plurality of external folds 18. In this embodiment, folds 18 mate with recesses 20 formed in wall 14 (refer FIG. 2).

Closure 10 includes a collapsible or movable core 22, which includes a flanged portion 24 which is useful to seal to opening 12. The end of collapsible core 22 opposite flanged portion 24 is received in base 26 when the closure is in position within wall 14.

As can be seen from FIG. 1, collapsible or movable core 22 contacts inner folds 28 of concertina element 16 causing external folds 18 to remain in contact with recesses 20 in wall 14.

When collapsible core 22 is caused to collapse—for example, because it is inflated and insertion of a corkscrew causes it to deflate, collapsible core 22 no longer presses concertina element 16 to remain in contact with recesses 20 in wall 14. As collapsible core 22 is withdrawn from opening 12, external folds 18 are caused to straighten progressively, collapsible core 22 no longer being in contact with base 26. Continued withdrawal of collapsible core 22 from opening 12 will cause all external folds 18 to be unfolded and the whole of closure 10 will be removed from within wall 14.

A tool other than a corkscrew may be used to deflate collapsible core 22 and remove it. Other methods of collapsing core 22 include, for example, the application of a partial vacuum. Once collapsible core 22 has collapsed, it takes less force to remove closure 10 than in the case of a conventional cork or a prior art synthetic cork.

Turning now to the embodiment in FIGS. 3 and 4, closure 30 is shown in FIG. 3 in place within wall 14. Opening 12 is sealed by flanged portion 32 connected to concertina element 34 having external folds 38 which contact the inner part of wall 14. Concertina element 34 also has inner folds, such as shown at 36 but these do not contact a collapsible core as in the FIG. 1/FIG. 2 embodiment. Rather, flanged portion 32 is connected to base 40 by tension cord 42. Tension cord 42 is secured to flanged portion 32 by insertion in sleeve 44.

To open closure 30, it is first necessary to break the connection between flanged portion 32 and tension cord 42. The coupling of tension cord 42 to flanged portion 32 may be such that sufficient force applied to flanged portion 32—for example, by inserting a pointed instrument in opening 12 between wall 14 and flanged portion 32—will break the connection with tension cord 42 and enable the folds of connection element 34 to be unravelled, in a similar manner to that described for FIGS. 1 and 2. Alternately, flanged portion 32 may be decoupled from tension cord 42 by using the type of "smart" release systems described in International Patent Application No. PCT/AU99/00185.

With reference to the embodiment in FIGS. 5 and 6, closure 50 is shown in FIG. 5 in situ within wall 14. Opening 12 is sealed by flanged portion 46, of which cork pellet 48 forms part. Cork pellet 48 may be made of natural cork or of some other suitable material.

Flanged portion 46 is also connected to concertina element 52 which has external folds 38 which contact the inner part of wall 14. Cork pellet 48 contacts some, but not all, of inner folds 36.

To open closure 50, a corkscrew or similar tool (not shown) may be inserted in cork pellet 48 so as to withdraw cork pellet 48 and surrounding flange 46 from opening 12. As this occurs, folds 36 and 38 of concertina element 52 will be caused to straighten, permitting closure 50 to be removed entirely from opening 12.

The embodiment in FIGS. 7 and 8 is similar to the embodiment in FIGS. 3 and 4, except that there is no tension rod or cord between flanged portion 32 and base 40. Rather, in the embodiment in FIGS. 7 and 8, closure 60 has inner and outer folds 36 and 38 maintained in position only by the suitability of the material from which closure 60 is made. Flanged portion 32 has connected to it (by knotting or other suitable means) a rip cord 54. Closure 60 is manufactured so that the exertion of sufficient force on rip cord 54 will cause inner folds 36 and outer folds 38 to straighten, permitting withdrawal of closure 60 from opening 12.

For aesthetic reasons, and to minimise the possibility of rip cord 54 being pulled accidentally, rip cord 54 may take the form of a ribbon or ornamental cord which can be secured to the outer part of wall 14, such as at position 56 on the neck of the bottle (not shown), by adhesion or using suitable packaging such as that commonly used on wine bottles.

Figure 10:
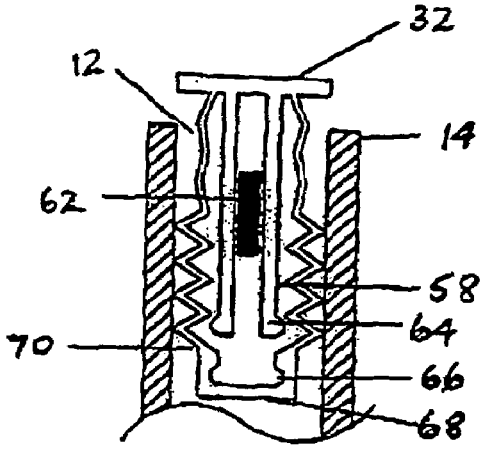

The embodiment in FIGS. 9 and 10 has a locking means as disclosed in international application No. PCT/AU99/00185. In this embodiment, closure 70 has contained within channel 58 a locking means 62 which is movable by remote activation means (not shown) between the locked position shown in FIG. 9 and the unlocked position shown in FIG. 10. Locking means 62 can be moved from one position to the other by remote activation means such as magnetic force, electromagnetic force, etc.

Channel 58 has at its open end rim 64 which fits into a complimentarily-shaped recess 66 in base 68 of closure 70.

To open closure 70, the remote activation means are used to unlock locking means 62 from rim 64, thus freeing channel 58 from base 68. Flanged portion 32 can then be pried out of opening 12 and the folds of concertina element 72 can be pulled relatively straight as shown in FIG. 10, as closure 70 is removed.

The embodiment in FIGS. 11 to 19 differs, it will be recalled, from the previous embodiments in the drawings in that the folds of the concertina element do not directly contact the wall of the passageway.

Specifically, in this embodiment closure 80 is moulded of polyethylene or other suitable material, having a concertina element 74 and an intermediate wall 76. Wall 76 is connected to one end of concertina element 74 while at the other end is located flange 77 having tab 78. Concertina element 74 includes a number of folded elements 82. Flange 77 optionally includes disc 84, made of wax or other frangible material and which can be printed or embossed with a trade mark or other material if desired (refer FIG. 19).

Figures 11, 12, 13, 14, 15, 16, 17, 18, 19:
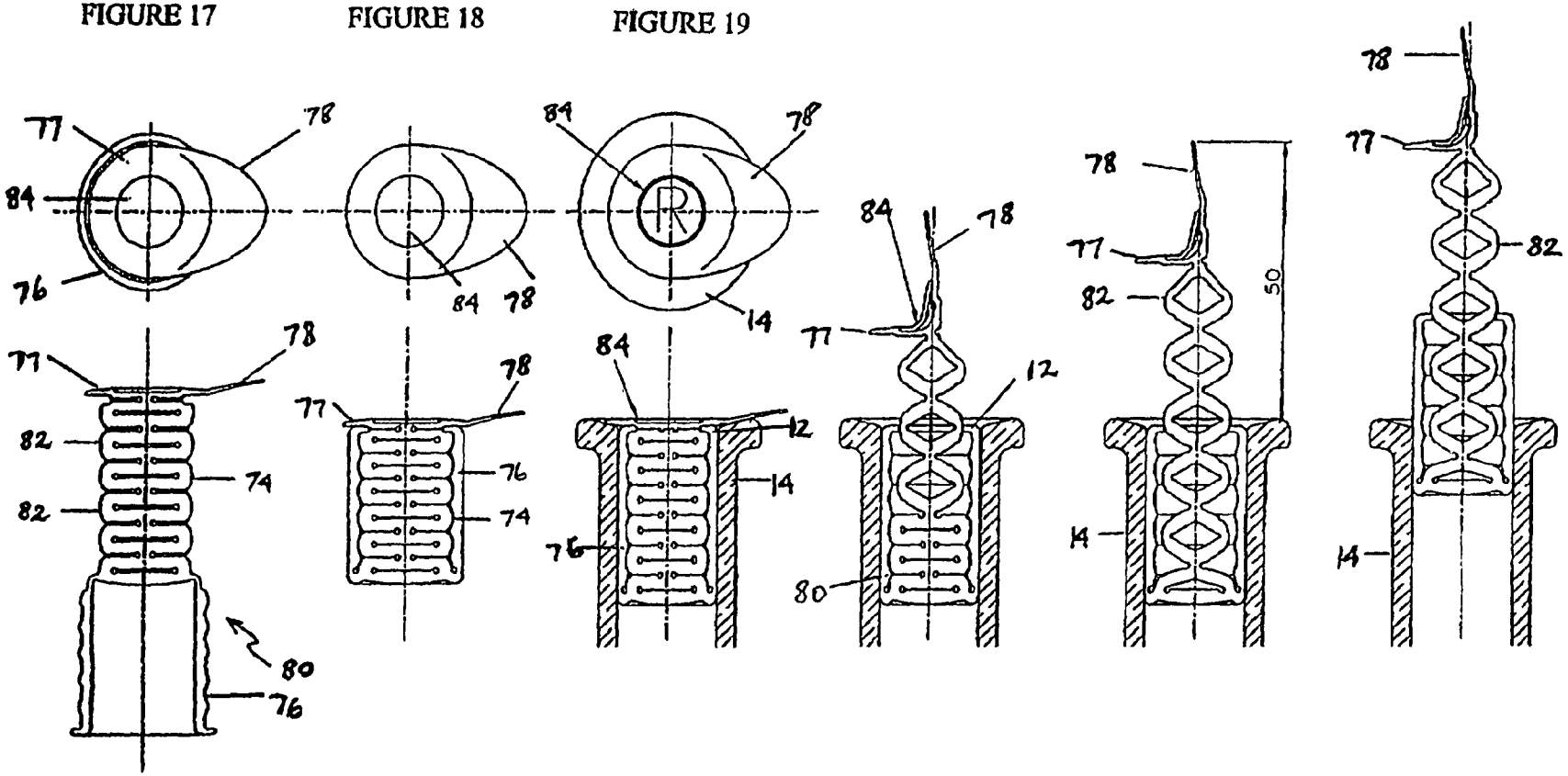
FIGS. 11 to 16 show in cross-sectional view a sixth embodiment of the invention.
FIG. 17 is a plan view of the closure of FIG. 11.
FIG. 18 is a plan view of the closure of FIG. 12
FIG. 19 is a plan view of the closure of FIG. 13.

Closure 80 is moulded in the form shown in FIG. 11. Before insertion in a passageway, concertina element 74 is pushed down into intermediate wall 76, which then wraps itself around concertina element 74 as shown in FIG. 12. Closure 80 is then inserted within wall 14 of a bottle neck, as shown in FIG. 13. In this position, flange 77 covers opening 12 and extends to cover substantially the thickness of wall 14. Depending on the construction of closure 80, it may be possible to use traditional corking equipment to insert closure 80 within wall 14.

To remove closure 80 from opening 12, tab 78 is bent manually as shown in FIG. 14, at the same time breaking disc 84 (which shows that an attempt has been made to remove closure 80 and thus can indicate tampering). Tab 78 is then used to withdraw closure 80 from opening 12, folded elements 82 gradually unravelling from concertina element 74 as force is exerted in an upward direction in the context of the embodiment in FIGS. 13 to 16.

FIG. 14 shows the commencement of withdrawal of closure 80 from opening 12, while FIGS. 15 and 16 show the intermediate and final stages of extraction of closure 80. It will be appreciated that once folded elements 82 are pulled out of their maximum folded position, pressure exerted by folded elements 82 on intermediate wall 76 is reduced and this facilitates withdrawal of closure 80 from opening 12 and from within wall 14.

Figure 20:
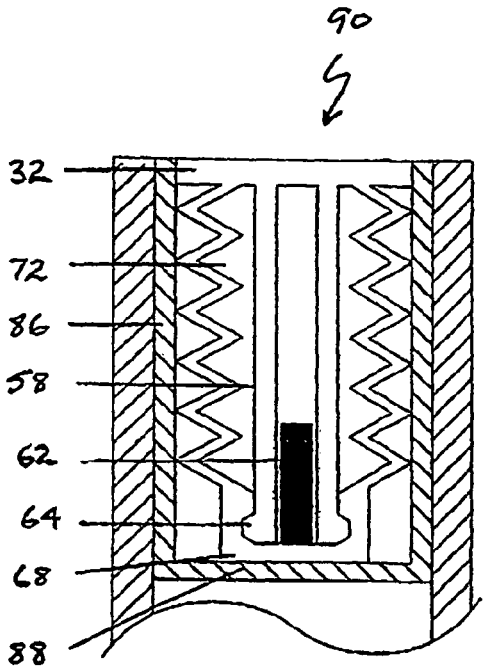
FIGS. 20 and 21 are cross-sectional views of a further embodiment, being similar to the embodiment in FIGS. 9 and 10 but having an intermediate wall.
Figure 21:
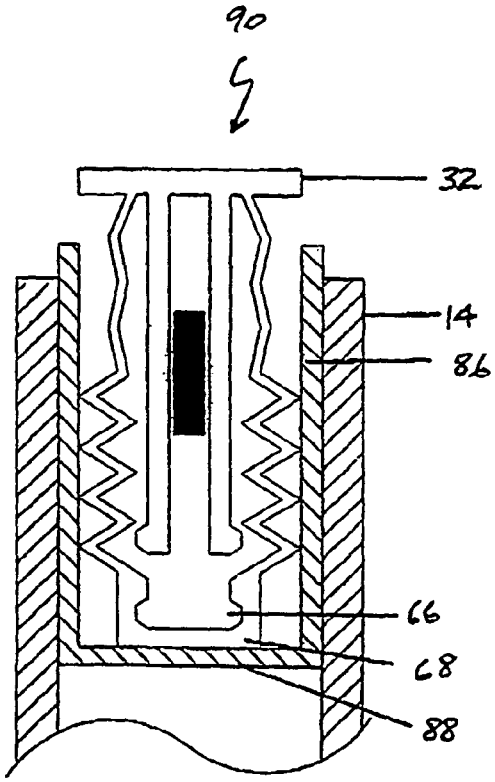

Closure 90 in FIGS. 20 and 21 is similar in its method of operation to closure 70 in FIGS. 9 and 10. Closure 90 differs, however, in that it includes intermediate wall 86. Intermediate wall 86, at the end opposite flange 32, has end 88 which gives strength to closure 90. The parts of closure 90 which are substantially the same as those of closure 70 carry the same labels in FIGS. 20 and 21.

Turning now to FIGS. 22-27, in this embodiment closure 100 has a spiral form concertina element 92 and an intermediate wall 94. Concertina element 92 includes edge 96 which can be used as a tab to withdraw concertina element 92 from closure 100. Base 98 of concertina element 92 is designed to fit into recess 102 of closure 100.

To extract closure 100 from a passageway (not shown), tab end 96 may be pulled in an upward direction in the view shown in FIG. 22 so that the coils of spiral 104 of concertina element 92 are stretched out Because base 98 is locked into recess 102, continued pulling on tab 96 will result in extraction of closure 100 from the passageway.

Figure 28:
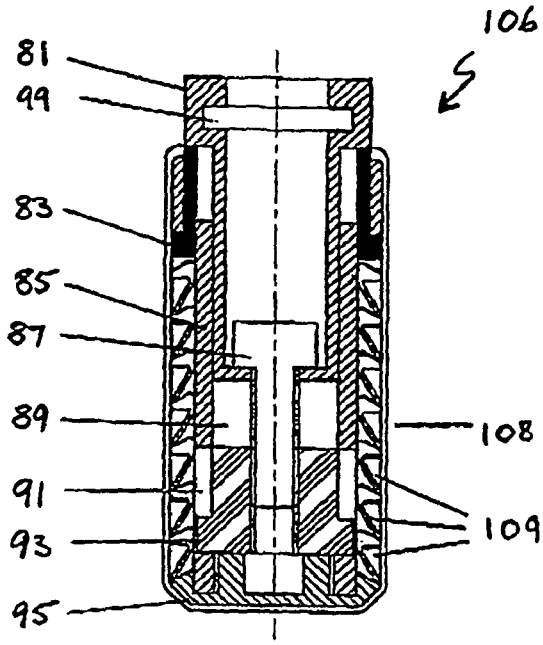
FIGS. 28, 29 and 30 illustrate in cross-section another embodiment in which the concertina element bears against the passageway wall by friction occasioned by compression and is released by release of the compression.
Figure 29:
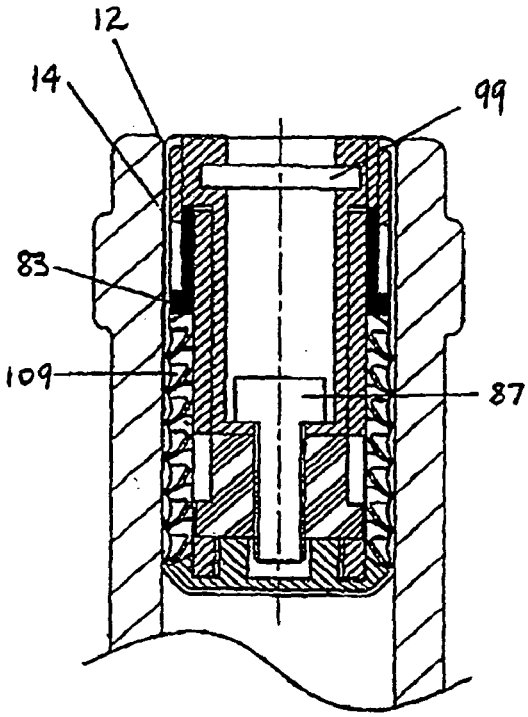
Figure 30:
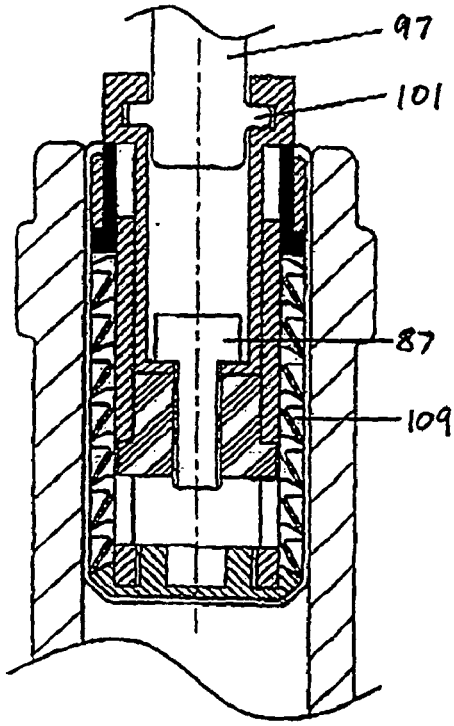

With reference to FIGS. 28 to 30, closure 106 is shown in "primed mode" in FIG. 28, in "sealed mode" in FIG. 29 and in "released-mode" in FIG. 30. Closure 106 has concertina element 108 which in turn has a plurality of folds, 109. Folds 109, when in the compressed state as shown in FIG. 29, contact wall 14 and retain closure 106 therein by friction.

Closure 106 includes drive sleeve 81, loading ring 83, main body 85, cap screw 87, bayonet cavity 89, flex ring 91, outer sleeve 93 and end cap 95.

To insert closure 106 in opening 12, drive sleeve 81 is forced into contact with main body 85, which at the same time drives loading ring 83 downwardly, to compress folds 109 of concertina element 108. This is performed by the application of suitable pressure, for example by a tool (not shown).

Cap screw 87 is screwed into tensioning contact with outer sleeve 93, to assume the position shown in FIG. 29. Cap screw 87 may be manipulated in this manner by a suitable tool (not shown).

In the sealed mode shown in FIG. 29, closure 106 is retained in opening 12 by friction caused by distortion of concertina folds 109 under tension caused by loading ring 83 and the positioning of cap screw 87 near end cap 95.

To release closure 106 from opening 12, extraction tool 97 (part of which is shown in FIG. 30) is inserted in bayonet opening 99 in drive sleeve 81 and rotated in order to adopt the configuration shown in FIG. 30, where ledge 101 engages bayonet opening 99. Extraction tool 97 is then drawn upwardly in a manner of a traditional cork pull. This draws drive sleeve 81, loading ring 83 and outer sleeve 93 away from folds 109 which are permitted to decompress, reducing friction between folds 109 and wall 14. Extraction tool 97 can then withdraw all of closure 106 from opening 12.

Figure 31:
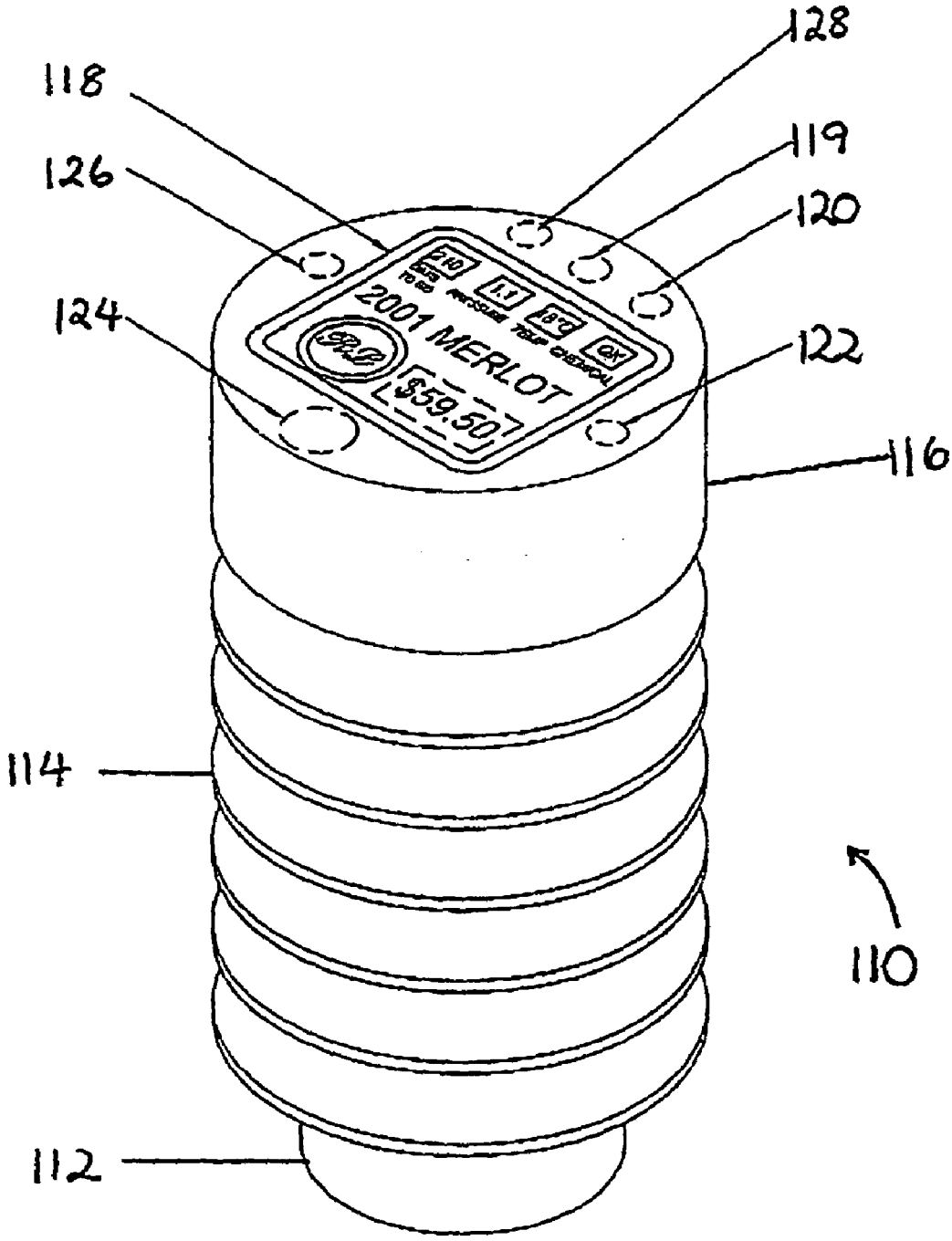
FIG. 31 is a perspective view of a closure according to a further embodiment.

In FIG. 31 there is shown a closure 110 including a base 112 from which extends a folded concertina element 114 and a display cap 116. On the top surface of the display cap 116 is an active display 118. The active display 118 may be in the form of liquid crystal display (LCD). As demonstrated in the drawing, the display 118 is adapted to display information concerning the expiry period relevant, for example to food, beverage, pharmaceutical or chemical contents, internal pressure is relevant to gaseous contents or contents capable of becoming gaseous, temperature and chemical concentrations, such as oxygen, carbon dioxide, alcohol or other chemical constituents which may indicate the status of the content. The display also includes product description information and commercial information such as price. The closure 110 may be described as a "smart" closure in that the processing means (not shown) contained therein is adapted to process information and data from a number of sources. The closure 110 includes a number of sensors, including a temperature sensor 119 and light sensor 120, which may be important in applications where the contents are subject to deterioration upon exposure to excessive temperature or long exposure to light, such as may be the case with certain complex organic chemicals including pharmaceuticals, and various food and beverage products, such as wines.

The closure 110 also includes a movement sensor 122 which may be adapted to sense the presence of a potential customer. Upon the detection of a potential customer, the closure 110 is provided with a speaker 124, which may be activated in response to movement sensor 122 input to provide the potential customer with product information which may relate to the real time status of the contents or merely provide general promotional information. The closure 110 is also provided with a microphone 126 capable of receiving voice input, which is able to be processed by the processing means to either provide the manufacturer, stock controller or retailer with the capacity to update the product information stored in the processing means via voice input data, or to enable a potential customer to obtain product information via speaker 124 responsive to voice input via microphone 126.

The closure 110 also includes a communication port 128 adapted to enable the transfer of data to and from the processing means using infra red (IR) signals. This feature is useful, particularly in recording a commercial transaction as will be described in more detail with reference to FIG. 34.

Figure 32:
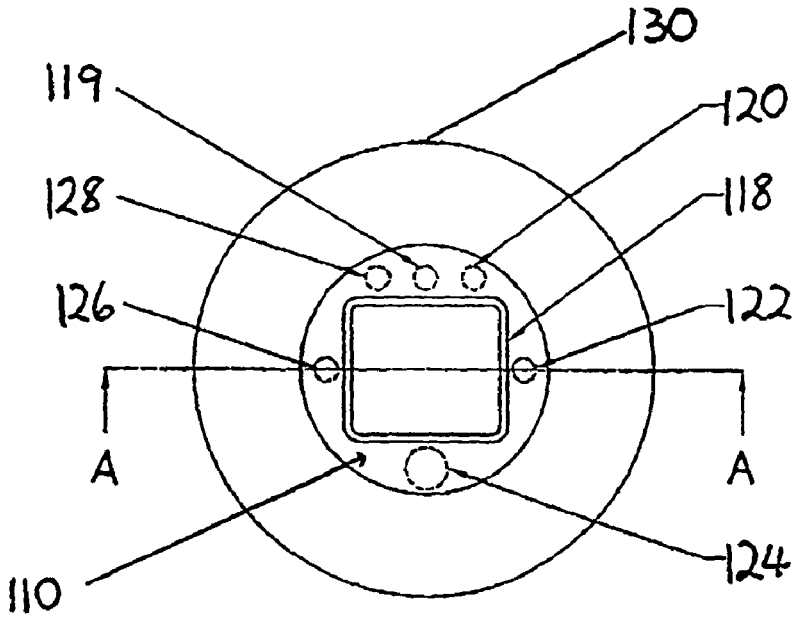
FIG. 32 is a plan view of the embodiment of FIG. 31.
Figure 33:
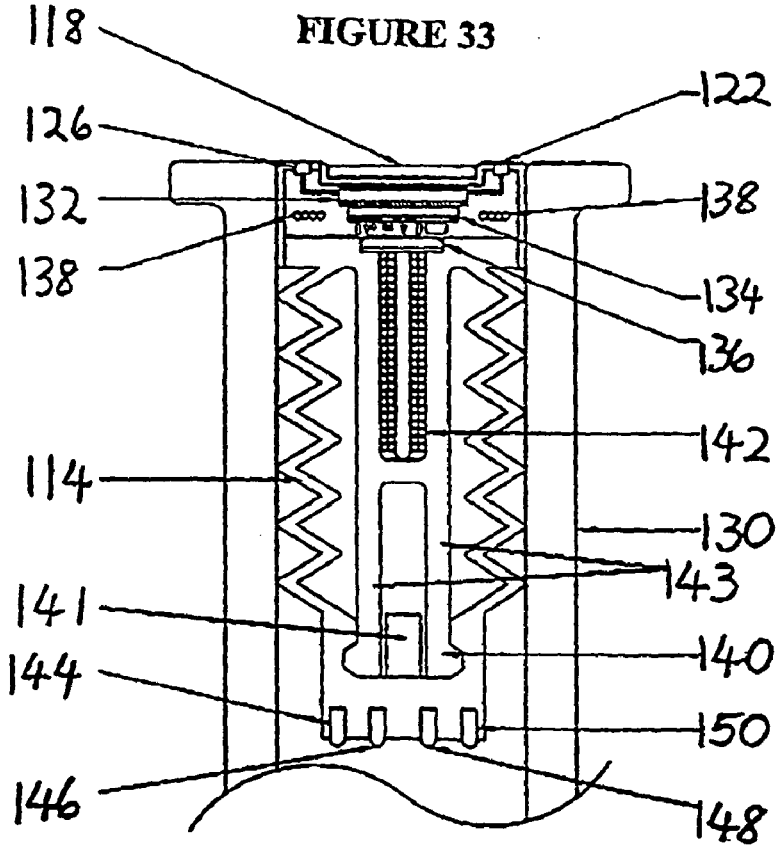
FIG. 33 is a side view of the embodiment of FIGS. 31 and 32 in situ along a cross-section A-A shown in FIG. 32.

Referring now to FIG. 32, the closure 110 is shown in the closed position in the neck 130 of a wine bottle (not fully shown). The closure 110 is sealably positioned in the neck 130 by the action of a concertina element 114 which, in its folded state as shown in FIG. 33, seals the container. The closure 110 includes a processor 132 located immediately underneath the display 118. The processor 132 is a microcomputer chip. Immediately underneath the processor 132 is a readable/writeable memory chip 134 and, in turn, immediately under the memory chip 134 is a power supply in the form of a wafer-thin nickel-cadmium battery 136. Surrounding and radially spaced from the memory chip 134 is an aerial coil 138 adapted to receive and transmit RF signals to enable remote interaction between the processor and an external processing means (not shown).

The closure 110 includes a release/fix arrangement 140 including an actuator 142. On application of certain conditions the actuator 142 is adapted to change dimensions and to release the closure 110 from the neck 130. Such conditions may be brought about by the radiation of the actuator 142 using RF, the passing of current through the actuator or the heating or cooling of the actuator as the case may be, using any one of the number of arrangements described in detail in application No. PCT/AU99/00185.

The actuator 142 is in the form of a solenoid capable of withdrawing wedge element 141 upwardly through a track defined by spaced downwardly depending arms 143. Upon upward movement of the wedge 141 the tower portions of arms 143 may be inwardly compressed to allow withdrawal of the closure 110 from the neck 130. A similar construction is described above with reference to FIGS. 9, 10, 20 and 21.

In the base 112 there are provided further sensors in communication with the processor 132. As shown in FIG. 33, the closure 110 includes a pressure sensor 144, an olfactory sensor 146, an internal temperature sensor 148 and a chemical sensor 150. Each of these sensors 144-150 is adapted to measure the various properties of the contents and to convey this information to the processor 132, optionally for display on display 118.

Figure 34:
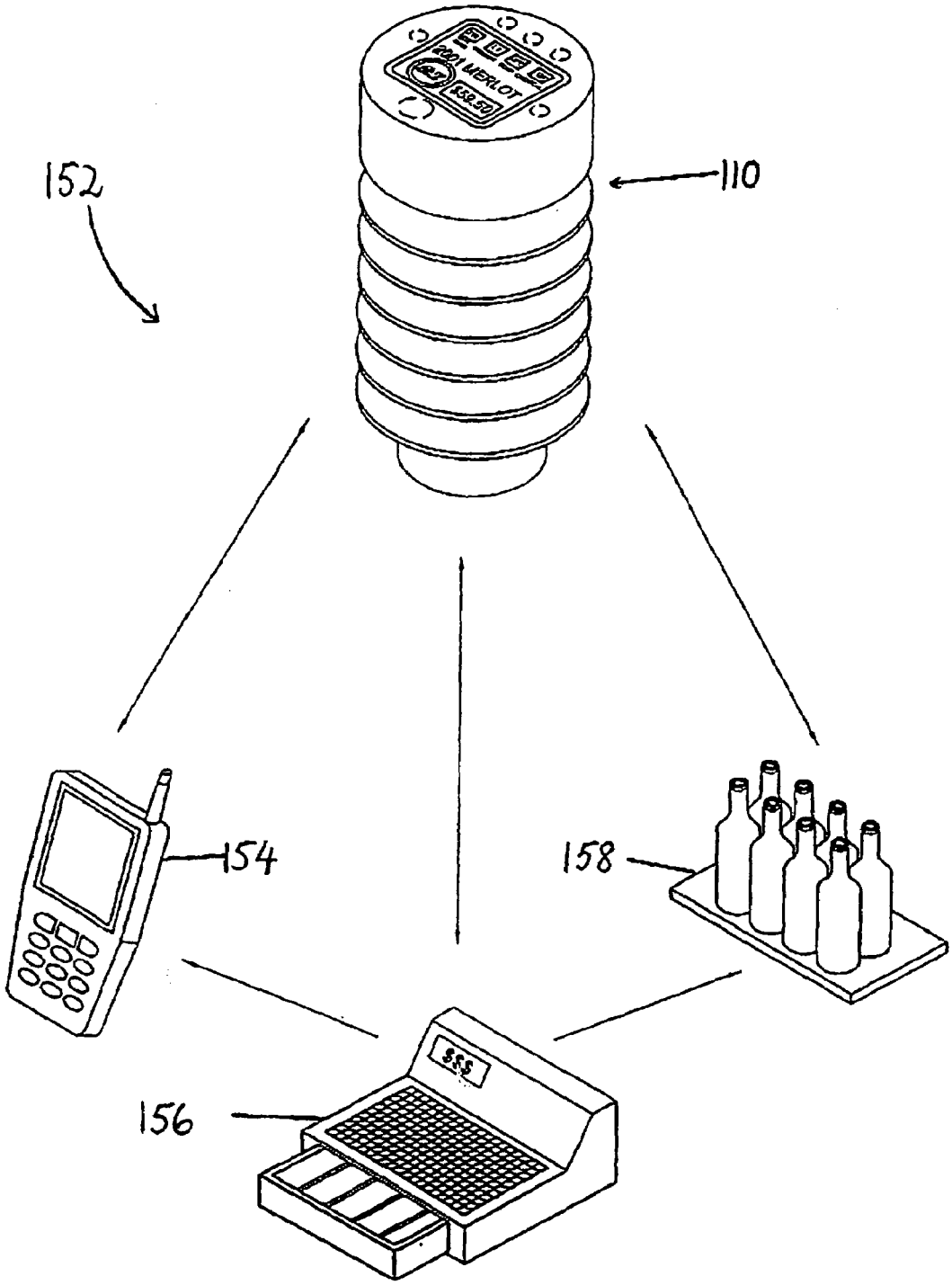
FIG. 34 is a schematic representation of a commercial system incorporating the closure of the embodiment in FIGS. 31 to 33.

In FIG. 34 there is shown a commercial system 152 including the closure 110, a customer communication unit in the form of a mobile phone 154, a retail communication and transaction central processor schematically represented as a cash register 156, also referred to as the retail network 156, and the manufacture/wholesale/distribution component 158 of the commercial system 152. The mobile phone 154 enables the customer to communicate with the processor 132 to down-load information concerning the product, whereby to discern whether the product ought to be purchased. If satisfied, the customer may then effect a commercial transaction with the retail network 156 whereby to purchase the product. Utilising the RF data transmission and receiving and IR port features available on most mobile phones and palm pilots, the customer has the capacity to interact with the processor via the corresponding communication means in the form of the RP transmitter/receiver means or the IR communication port 128.

To effect a transaction the customer may use the mobile phone 154 to interface with the retail network 156 whereby to effect the transfer of monies from the customer's account to the retailer's account. Once the transaction is complete, the retail network 156 interfaces with the closure 110 instructing the latter to unlock on instructions from the customer via the mobile phone 154. This enables the customer to trigger the release/fix arrangement 140 and to interface fully with the processor 132 via the mobile phone 154.

Prior to sale, the processor 132 fully interfaces with the retail network 156, with the exception that the retail network 156 may not have authority to activate the release/fix arrangement 140. Immediately following a transaction, the retail network 156 communicates with the stock control, distribution and manufacturing facilities of the system 152 to place replacement-orders for the product to maintain stock levels by ensuring timely manufacture and appropriate distribution. During the stock control, distribution and particularly the manufacturing process, there is capacity to interface with the processor 132 providing feedback to assist in external climate control via temperature sensor 119 and light sensor 120 and to monitor internal contents factors such as pressure, olfactory, temperature and chemical status via sensors 144, 146, 148, 150. This facilitates the maintenance of optimum external conditions for the product and can be used to monitor for signs of contamination or spoiling of the contents.

Figure 35:
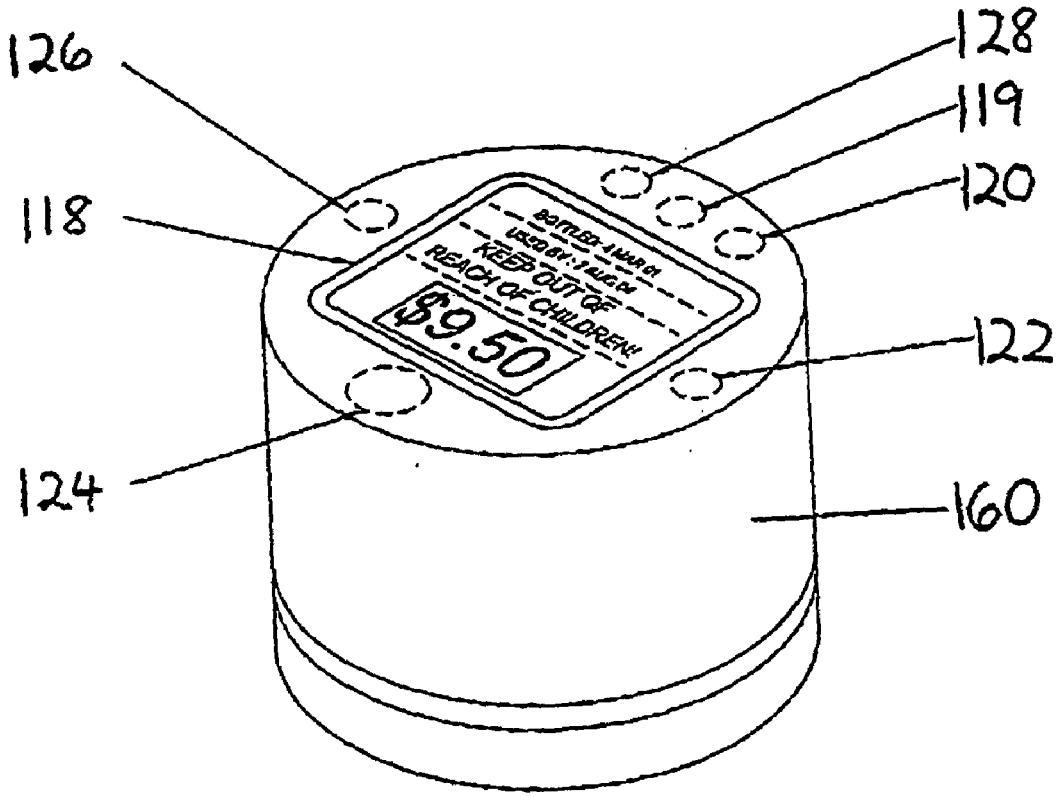
FIG. 35 is a perspective view of a closure according to a further embodiment.

FIG. 35 shows a second embodiment of a screw top closure 160 having corresponding features to that of closure 110, namely a display 118, temperature sensor 119, light sensor 120, movement sensor 122, speaker 124, microphone 126 and IR communications port 128. Such a screw top cap 160 may be used as a closure for pharmaceutical products, such as analgesics, mineral liquids, such as turpentine and any other product requiring a secure lid for practical or regulatory purposes.

Figure 36:
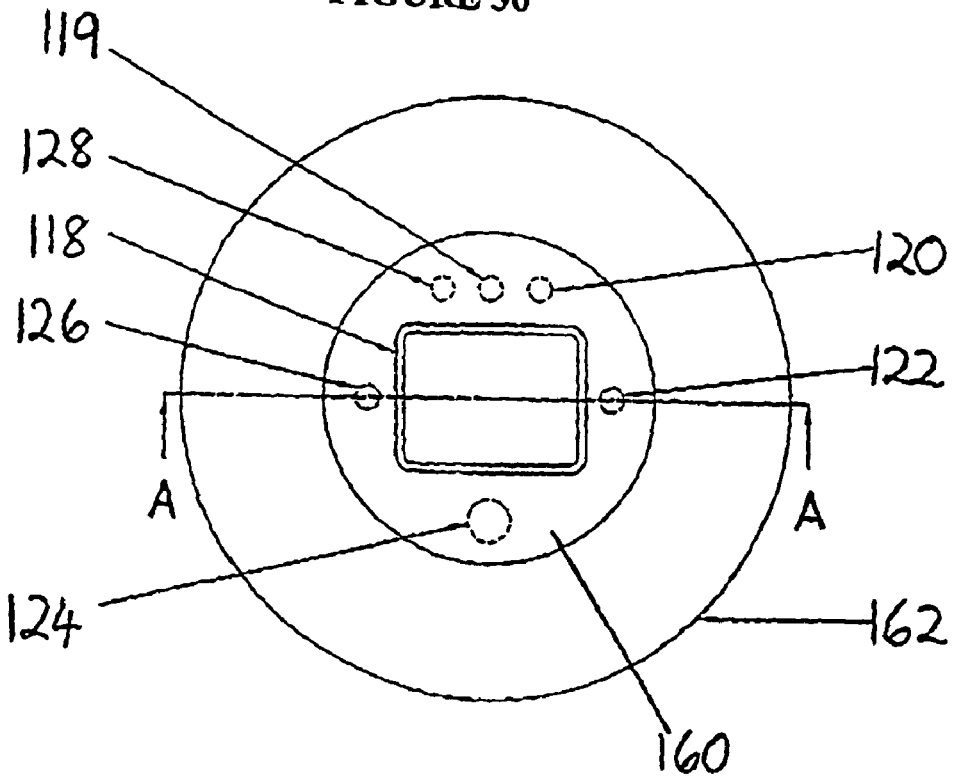
FIG. 36 is a top plan view of the closure according to the embodiment of FIG. 35.
Figure 37:
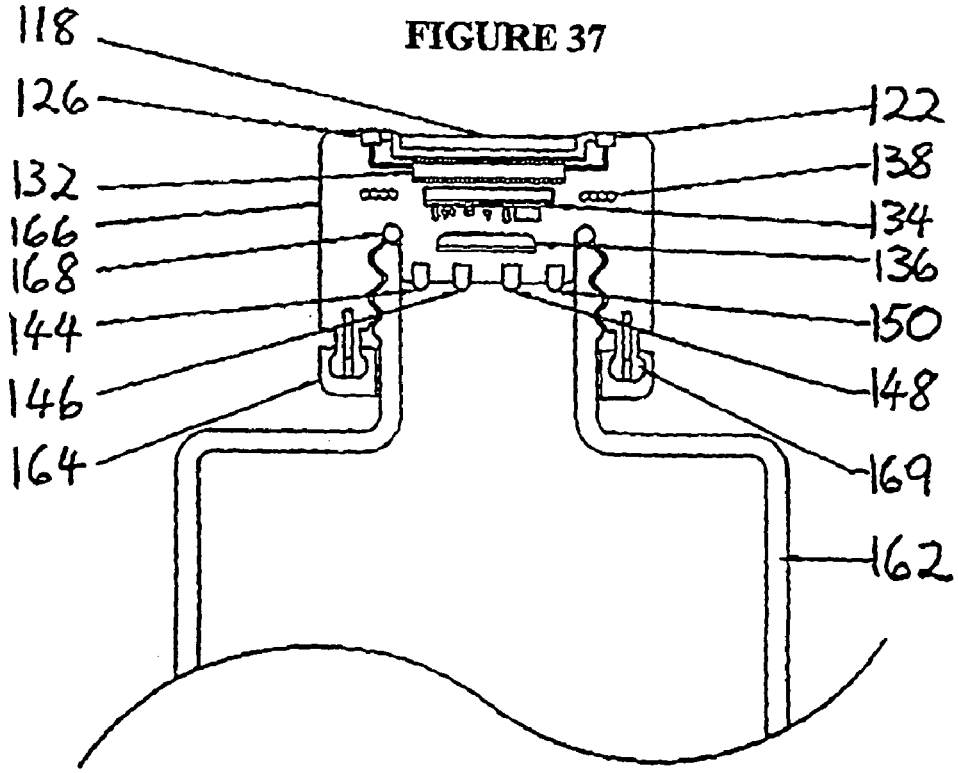
FIG. 37 is a side view of the closure of the embodiment of FIGS. 35 and 36 shown in cross-section A-A in FIG. 36.

FIG. 36 shows a top plan view of the closure 160 secured to a bottle 162. FIG. 37 shows a cross-sectional side view of the closure 160 on the bottle 162. The closure 160 has similar features to closure 110 which are correspondingly referenced using the same numeral as in FIG. 33, namely display 118, microphone 126, processor 132, memory chip 134, battery 136, RF aerial coil 138 and sensors 122, 144, 146, 148, 150.

The closure 160 is internally threaded to correspond with the external thread of the bottle 162 and has a tamper-evident security collar 164 depending downwardly from the closure skirt 166 below the threaded portions in the closed position. The closure 160 has an annular seal 168 adapted to be seated around the top annular surface of the threaded portion of the bottle 162, which is releasably secured to the skirt 166 by a release/fix arrangement, 169 similar to the release/fix arrangement 140 described in FIG. 33 but on a smaller scale, and may include two or more discreet arrangements 169 spaced around the collar 164. The collar 164 may or may not be frangibly attached to the skirt 166. Preferably, the collar 164 is engaged with the skirt 166 by the release/fix arrangement 169 and is detachable from the skirt 166 by the operation of the release/fix arrangement 169. Optionally, the release/fix arrangement 169 may not be restorable to its original closed position, whereby to indicate tampering if required.

Figure 38:
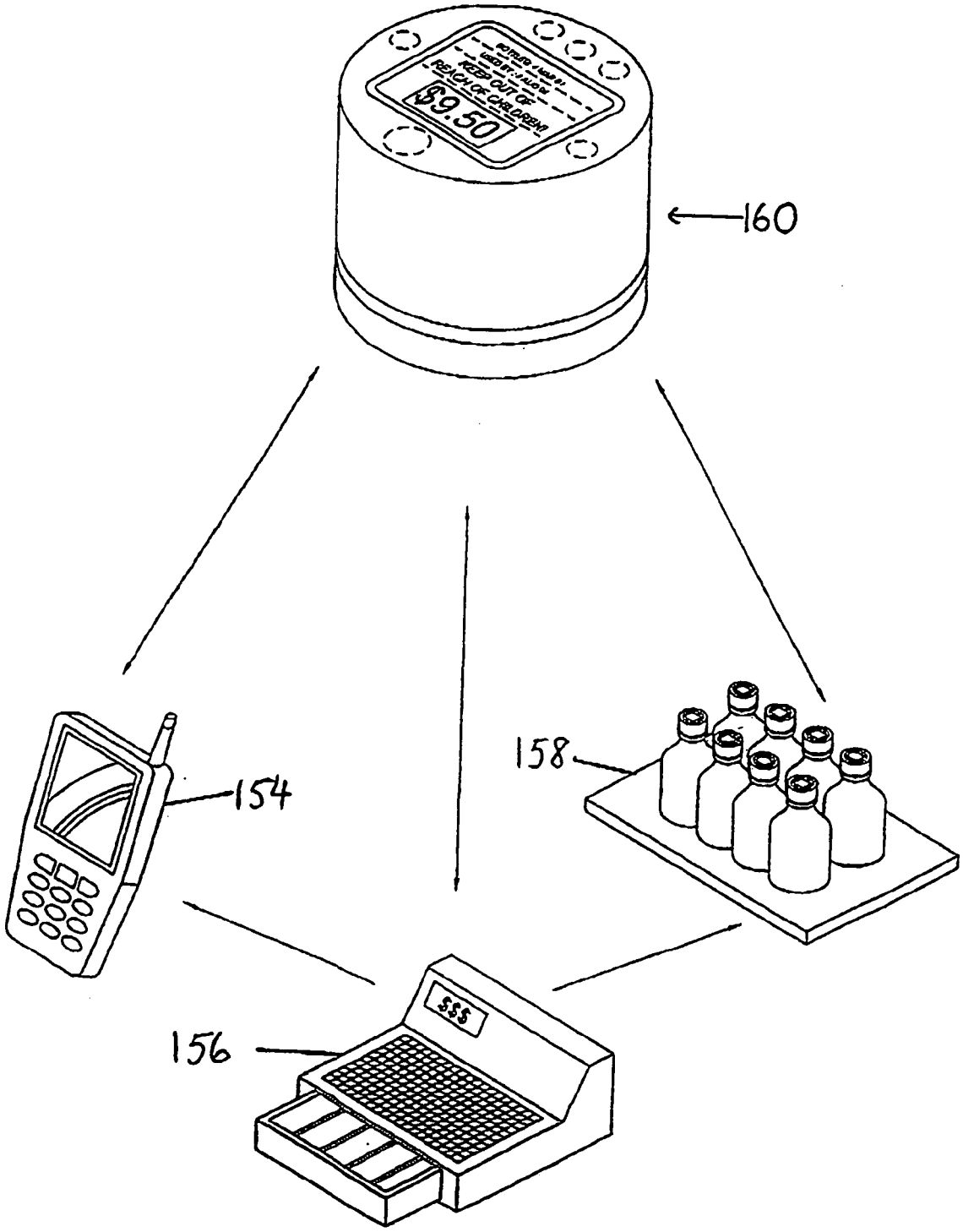
FIG. 38 is a schematic representation of a commercial system incorporating the closure according to the embodiment of FIGS. 35 to 37.

FIG. 38 shows a commercial system 172 analogous to the commercial system 152 described with reference to FIG. 34.

Figure 39:
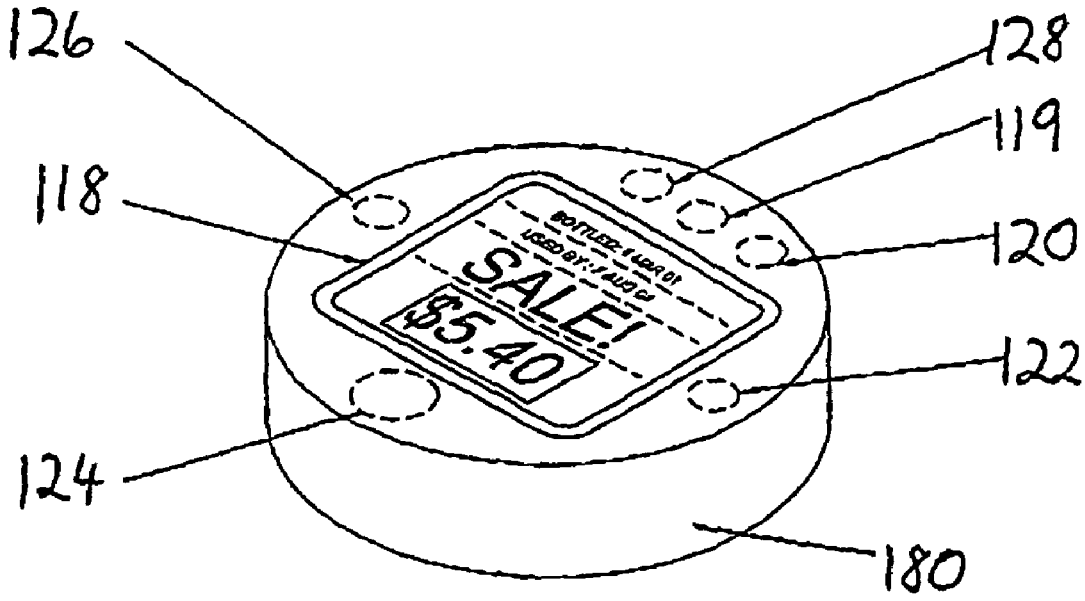
FIG. 39 is a perspective view of a closure according to a further embodiment.
Figure 40:
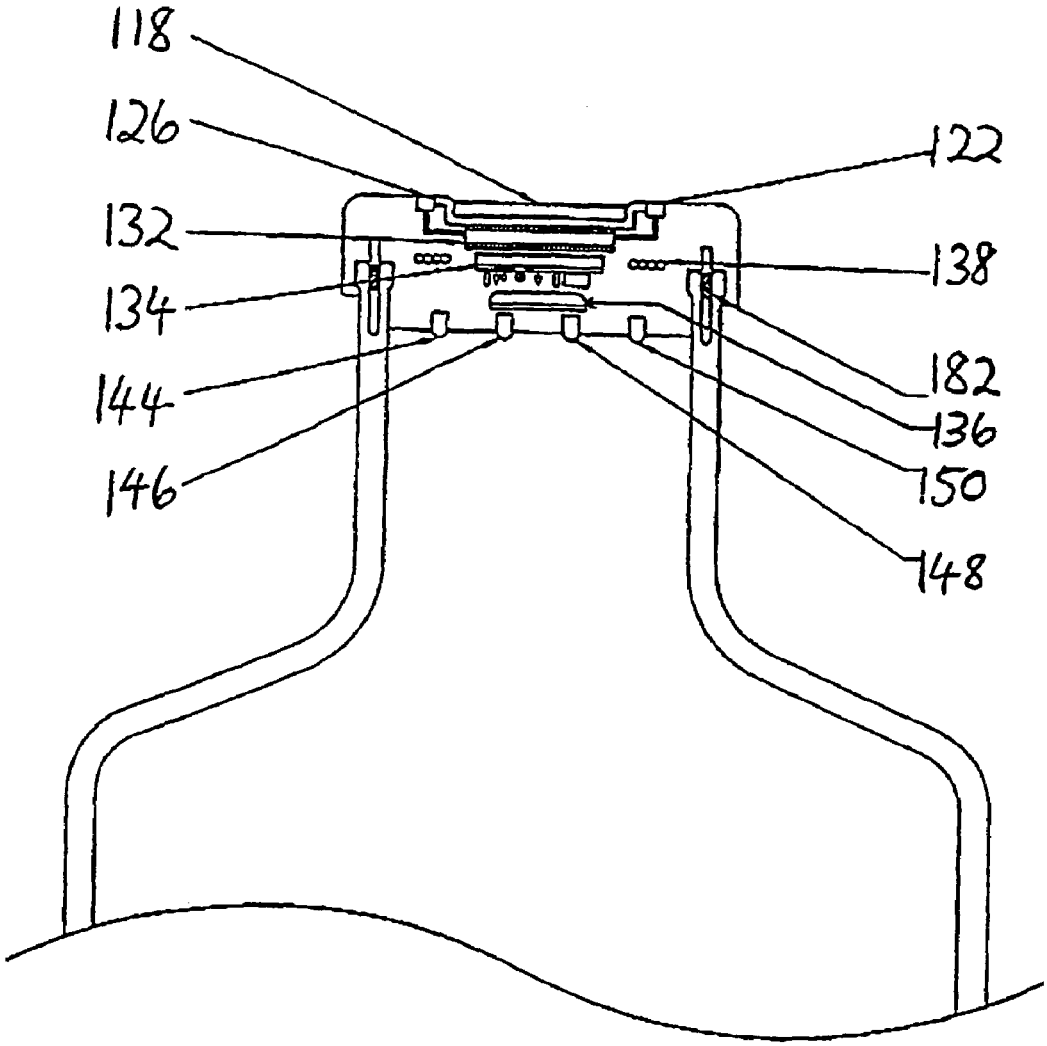
FIG. 40 is a side view of the closure according to the embodiment of FIG. 39 shown in transverse section in situ.

Turning now to FIGS. 39 and 40, there is shown a snap-on cap 110 showing features analogous to those described for closure 110 in FIGS. 32 and 33, namely display 118, temperature sensor 119, light sensor 120, movement sensor 122, speaker 124, microphone 126, IR communications port 128, processor 132, memory chip 134, battery 136, RF aerial coil 138 and sensors 144, 146, 148, 150. A release/fix arrangement 182 is provided which is analogous in operation to the release/fix arrangement 169 described with reference to FIG. 37. Alternatively, the release/fix arrangement involves the use of shape-memory material adapted to alter its dimensions upon the application of a change in temperature by means of heating element, the passing of an electrical current through and like mechanism known to the art, such as those described in the aforementioned application No. PCT/AU99/00185.

Figure 41:
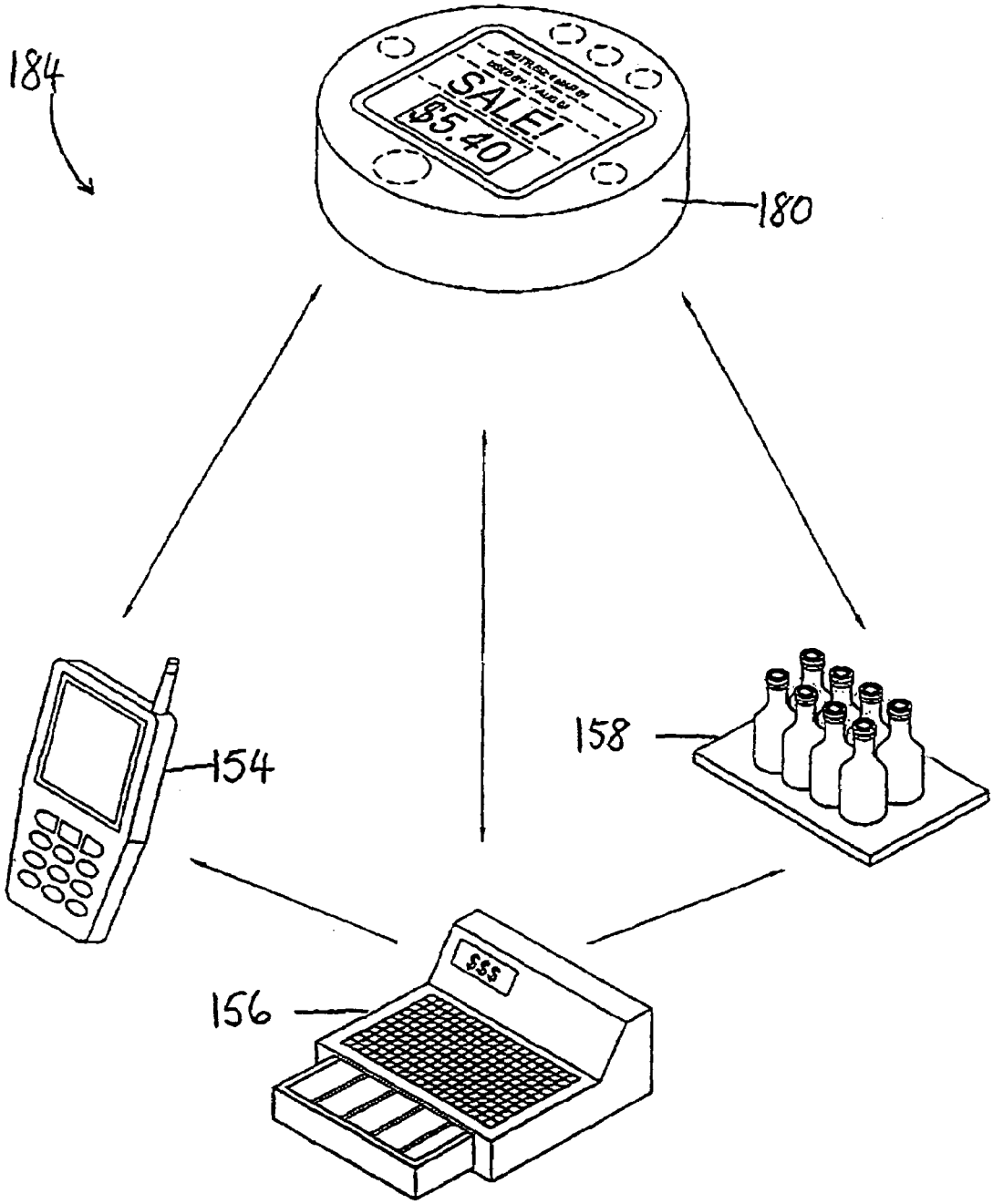
FIG. 41 is a schematic representation of a commercial system incorporating the closure of the embodiment of FIG. 39.

FIG. 41 shows a commercial system 184 incorporating snap-on cap 180 and is analogous to the commercial system 152 described with reference to FIG. 34.

Figure 42:
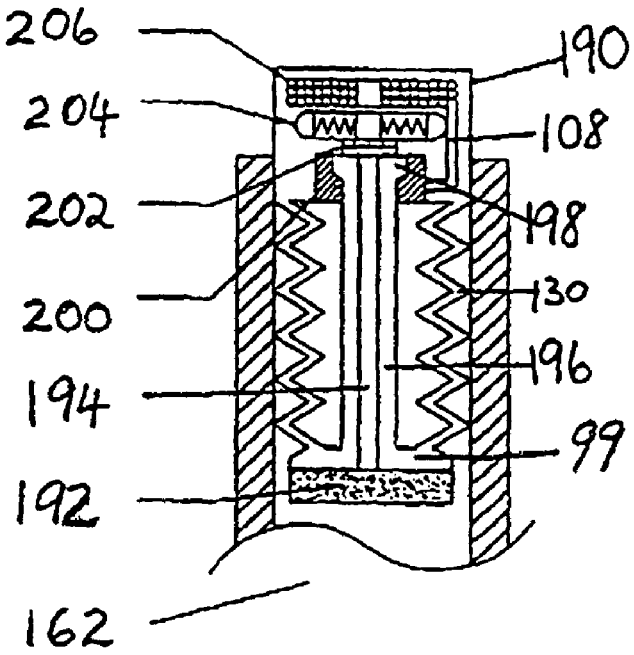
FIG. 42 is a cross-sectional side view of a closure according to a further embodiment of the invention, shown in the sealed position.
Figure 43:
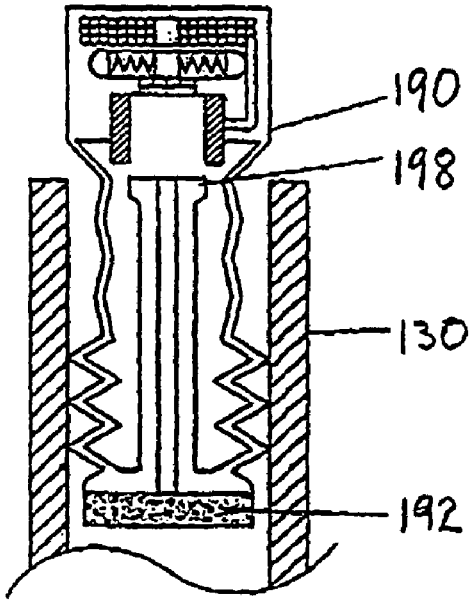
FIG. 43 shows the closure of the embodiment of FIG. 42 in the process of assuming an open position.
Figure 47:
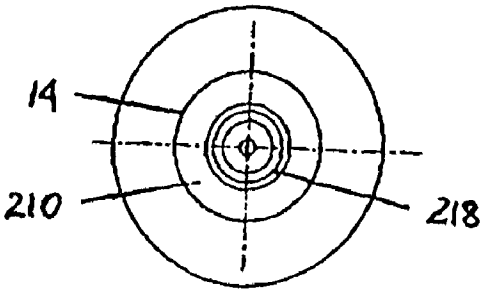
FIG. 47 is a top view of the closure shown in FIG. 46.

FIG. 42 shows a closure 190 according to a fourth embodiment of the invention secured in the neck 130 of a bottle. The basic function of the closure 190 is to serve as a cork and it has an arrangement similar to closure 110 described with reference to FIG. 33 with regard to the provision of a concertina element 114 adapted to engage the internal cylindrical surface of the neck 130. The closure 190 has at its base a vapour porous membrane 192 adapted to permit material to migrate up the centre of the closure 190, being a hollow bore defined by arms 196. The arms 196 are formed integrally with the concertina element 114 via a base portion 199 to which the membrane 192 is adhered. At the upper end of each of arms 196 is an outwardly extending protrusion 198 adapted to engage complementarily shaped memory material 200. At the upper end of bore 194 is a temperature and olfactory sensor chip 202. The sensor chip 202 is in communication with the contents of the bottle 162 via the membrane 192. Immediately above the sensor chip 202 is an encryption security tag 204 including an RF antenna for remote control. Immediately above the security tag 204 in the upper portion of the head of closure 190 is an induction coil conductively connected to the memory material 200 via conductors 208. Upon receiving an encrypted signal from, for example a mobile phone or dedicated instrument, the security tag 204 activates an induction coil 206 whereby to heat the shape-memory material 200 causing expansion and permitting release of protrusions 198, whereby to permit the closure 190 to be removed from the neck 130 by unravelling the concertina element 114 as shown in FIG. 43.

Referring now to the embodiment in FIGS. 44 to 47, closure 210 has body 212 made of plastic or other suitable material. Inserted in cavity 214 is plastic ring 216 which has a memory of an expanded shape, capable of triggering by application of heat energy. Body 212 includes passage 218, which is shaped to receive insertion tool 220. Closure 210 also includes chip 222 which is of the "Bluetooth" (trade mark) type, enabling wireless linking between the chip and other devices such as computers, mobile phones and other portable, hand-held devices.

Figure 44:
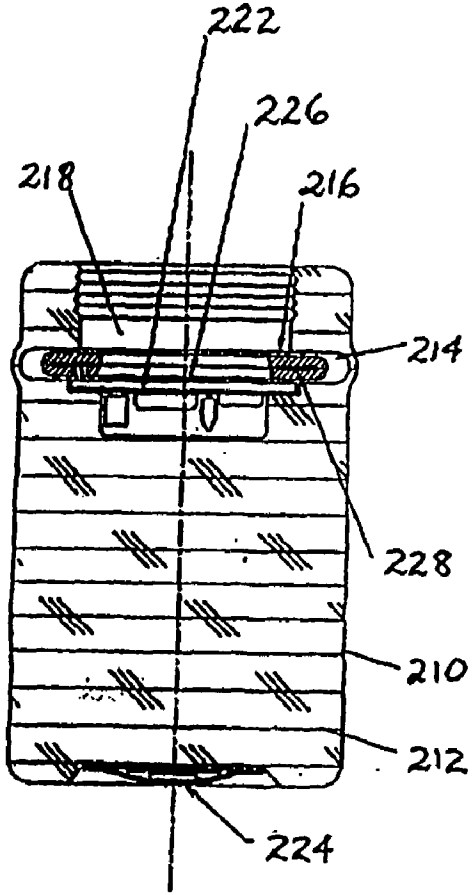
FIG. 44 is a cross-sectional view of a further embodiment of the invention.

In the configuration shown in FIG. 44, closure 210 is in an uncompressed state. It includes olfactory chip 224.

Figure 46:
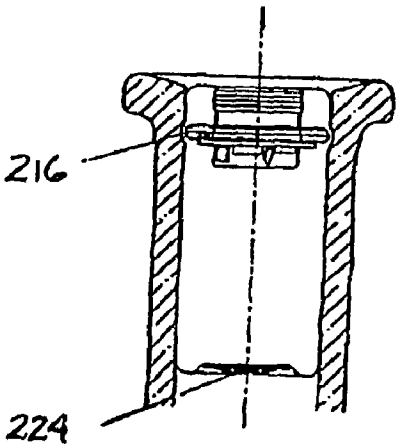
FIG. 46 shows the closure of the embodiment of FIGS. 44 and 45 in situ.
Figure 45:
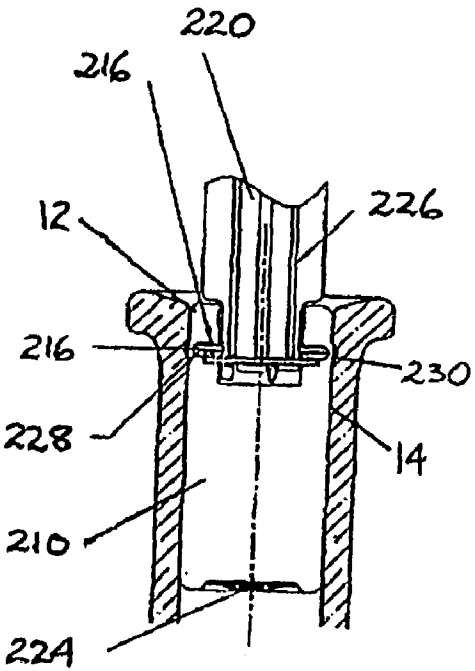
FIG. 45 shows the closure of the embodiment of FIG. 44 being inserted into the neck of a container.

FIG. 45 shows closure 210 during insertion into opening 12 of a bottle, only part of which is shown in FIG. 45. Insertion tool 220 includes electrical contacts 226 which, once closure 210 is in position within wall 14, can be activated to cause heater element 228 in plastic ring 216 to heat plastic ring 216 to assume its memorised shape. This is illustrated in FIG. 46, where it can be seen that plastic ring 216 has expanded to force closure 210 to fill channel 230 in wall 14. This, and the push-fit between closure 210 and the rest of wall 14, ensures that closure 210 adequately seals opening 12 of the bottle.

Figure 49:
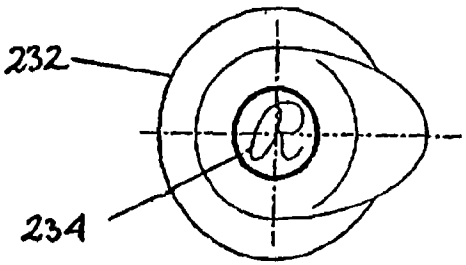
FIG. 49 is a top view of the closure of FIG. 48.
Figure 48:
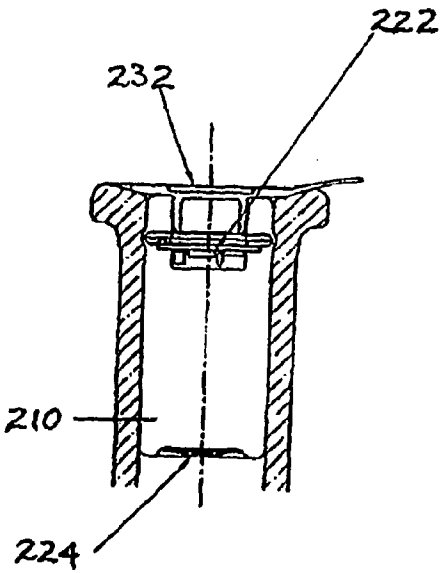
FIG. 48 is a cross-sectional side view of a closure according to a further embodiment in the sealed position in the neck of a container.
Figure 50:
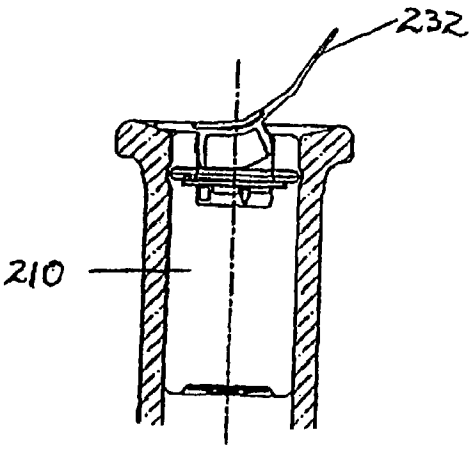
FIG. 50 shows the breaking of a seal of the embodiment of FIG. 48.

The embodiment in FIGS. 49 and 50 is a development of that in FIGS. 44 to 47, in that tamper-evident lid and seal 232 has been added to the configuration in FIG. 46. Seal 232 may of course carry trade marks or other proprietary indicia such as that indicated at 234.

As shown in FIG. 50, seal 232 may be broken and removed at the appropriate time.

In the case of either embodiment in FIG. 46 or that in FIG. 50, olfactory chip 224 is available to test if the contents of the bottle are fit for consumption or if they have been spoiled, etc. For example, where the contents of the bottle consist of wine, olfactory chip 224 can report whether the wine is ready for drinking or tainted or whether it should be cellared for a longer period. Information conveyed by olfactory chip 224 can be communicated to an enquirer via chip 222 or by any other suitable means.

Chip 222 can be encoded with a bottling time code and any other suitable consumer information, as required.

Throughout the specification the word "comprise" and its derivatives is intended to have an inclusive rather than exclusive meaning unless the context requires otherwise.

It will be appreciate by those skilled in the art that many modifications and variations may be made to the embodiments described herein without departing from the spirit or scope of the invention.

Without limiting the scope of the foregoing statement, features from various embodiments may be combined with features from other embodiments disclosed herein.

INDUSTRIAL APPLICABILITY

It will be appreciated by those skilled in the art that the closures of the present invention have decided advantages over prior art closures. In some versions, the closures can be extracted without the need for any tools other than the fingers of the user. In others, simple tools can be used, including traditional corkscrews. Modern technology can also be applied, such as the use of a magnetic field to remotely "unlock" the closure.

Sophisticated versions of closures can report on the state of contents of a container. The closure of the invention can also enable an efficient commercial system to be utilised, in which mobile phones or similar communication device can be used to communicate with the product carrying the closure, with the option of releasing the closure during part of the commercial transaction.

The invention claimed is:

1. A closure for a passageway having one or more walls and a mouth defined by the wall or walls, the closure including:

an upper end adapted in use to be located at the mouth;

a base adapted in use to be located within the wall or walls remote from the mouth; and a concertina element having internal folds and external folds, the concertina element being adapted to retain the closure in use in place between the wall or walls and being capable of being unfolded to allow the closure to be removed from the wall or walls, characterised in that the base is closed.

2. The closure of claim 1, wherein the passageway is a bottle neck.

3. The closure of claim 1, wherein the passageway is of regular cross-section.

4. The closure of claim 1, wherein the wall or walls are ribbed, threaded or smooth.

5. The closure of claim 1, wherein the closure seals the mouth completely in situ.

6. The closure of claim 5, wherein the closure seals the mouth and the surrounding wall or walls.

7. The closure of claim 1, wherein the closure is retained in place by friction.

8. The closure of claim 1, wherein the external folds are adapted to bear against the wall or walls of the passageway when the closure is in use.

9. The closure of claim 8, which includes a collapsible core adapted to contact the internal folds of the concertina element and cause the external folds to bear against the wall or walls of the passageway when the closure is in use.

10. The closure of claim 9, wherein the core is inflatable.

11. The closure of claim 8, which includes means adapted to hold the upper end in fixed relationship to the closed base.

12. The closure of claim 11, wherein the means comprise a tension cord linking the upper end with the closed base.

13. The closure of claim 8, which includes an internal core adapted to contact at least some of the internal folds of the concertina element and cause the external folds to bear against the wall or walls of the passageway when the closure is in use.

14. The closure of claim 13, wherein the internal core is made of cork.

15. The closure of claim 1, wherein the concertina element is adapted to retain the closure in place by a locking element adapted to be unlocked by remote activation means to allow the closure to be removed from the wall or walls.

16. The closure of claim 15, wherein the locking element is adapted to be unlocked by application of a magnetic field.

17. The closure of claim 1, which includes an intermediate wall or walls, the external folds of the concertina element being adapted in use to bear against the intermediate wall or walls, which are adapted in use to bear against the wall or walls of the passageway.

18. The closure of claim 1 or 17, wherein the concertina element has folds forming a spiral.

19. The closure of claim 1 or 17, wherein the concertina element is adapted to be released by manipulation of a cord, ribbon or flange attached to the closure.

20. The closure of claim 1 or 17, wherein the closure includes means for sensing at least one characteristic of a nearby substance.

21. The closure of claim 20, wherein the or each characteristic is chosen from the group comprising: temperature, pressure, chemical composition, presence of a gas and absence of a gas.

22. The closure of claim 20, wherein the means for sensing is chosen from the group comprising: a temperature sensor, a pressure sensor and a chemical sensor.

23. A closure as claimed in claim 20, which includes means for indicating information received from the sensor.

24. The closure of claim 23, wherein the indicating means is a light or an information display.

25. The closure of claim 20, which further includes a display showing price or period remaining before a chosen deadline.

26. The closure of claim 25, wherein the display is adapted to be changed by an external signal.

27. The closure of claim 1 or 17, wherein the closure includes means for sensing light or movement.

* * * * *